US005157239A

United States Patent [19]

Kanaya et al.

[11] Patent Number: 5,157,239

[45] Date of Patent: Oct. 20, 1992

[54] OVEN

[75] Inventors: Yoshihiro Kanaya; Makoto Morishima, both of Nagoya, Japan

[73] Assignee: Rinnai Kabushiki Kaisha, Japan

[21] Appl. No.: 524,205

[22] Filed: May 16, 1990

[30] Foreign Application Priority Data

May 19, 1989 [JP] Japan ..... 1-126184

[51] Int. Cl.[5] ..... H05B 3/62; F24C 7/04

[52] U.S. Cl. ..... 219/411; 392/408

[58] Field of Search ..... 362/92; 219/391, 411, 219/405, 411; 392/407, 408, 411

[56] References Cited

U.S. PATENT DOCUMENTS

| | | | |
|---|---|---|---|
| 2,824,943 | 2/1958 | Laughlin | 219/411 |
| 3,249,741 | 5/1966 | Mills | 219/411 |
| 3,614,388 | 10/1971 | Robinson | 219/400 |
| 3,884,213 | 5/1975 | Smith | 219/400 |
| 4,680,450 | 7/1987 | Thorson | 219/411 |
| 4,730,100 | 3/1988 | Pingelton | 219/400 |
| 4,923,681 | 5/1990 | Cox | 219/400 |
| 4,965,434 | 10/1990 | Nomura | 392/407 |

FOREIGN PATENT DOCUMENTS

| | | | |
|---|---|---|---|
| 60-245933 | 12/1985 | Japan | 219/411 |

*Primary Examiner*—Teresa J. Walberg

*Attorney, Agent, or Firm*—Robbins, Dalgarn, Berliner & Carson

[57] ABSTRACT

There is disclosed an oven comprising at least one halogen lamp (4*a*) provided with a far infrared coating and at least one halogen lamp (4*b*) without a far infrared coating, both halogen lamps (4*a*, 4*b*) being disposed in a grill chamber having on the front a door which can be opened and closed.

4 Claims, 2 Drawing Sheets

OVEN

This invention relates to an oven using halogen lamps.

An oven using halogen lamps as a heat source is conventionally known, for example, from JP-B-34426/1988.

This oven, however, is nothing but a one provided with halogen lamps and, therefore, has a disadvantage in that it cannot control the extend of grilling and scorching (browning), both of which are essential in grill cooking.

This invention has for its object to provide an oven without this kind of disadvantage.

In order to attain this object, the oven comprises at least one halogen lamp provided with a far infrared coating and least one halogen lamp without a far infrared coating, both of the halogen lamps being disposed in an oven chamber having on the front side thereof a door which can be opened and closed. Preferably, the lamp provided with the far infrared coating and the lamp without the far infrared coating are independently controlled.

In an oven having the above-mentioned construction, far infrared rays can be radiated from the halogen lamp provided with the far infrared coating whereby a material cooking inside the oven can be cooked by heating from the inside thereof and, at the same time, near infrared rays can be radiated from the halogen lamp without the far infrared coating whereby the material cooking can be scorched on the surface thereof. Furthermore, the inside of the oven can be illuminated by a brilliant light which is radiated from the halogen lamp without the far infrared coating and is peculiar to the halogen lamp and, therefore, the scorching degree and the like of the material cooking can be confirmed without providing a lamp for lighting purposes.

Furthermore, in the preferred oven, by independently controlling the halogen lamps, various types of cooking are made possible by the combination of the lamps.

An embodiment of this invention is described with reference to the drawings in which.

Figure 1:
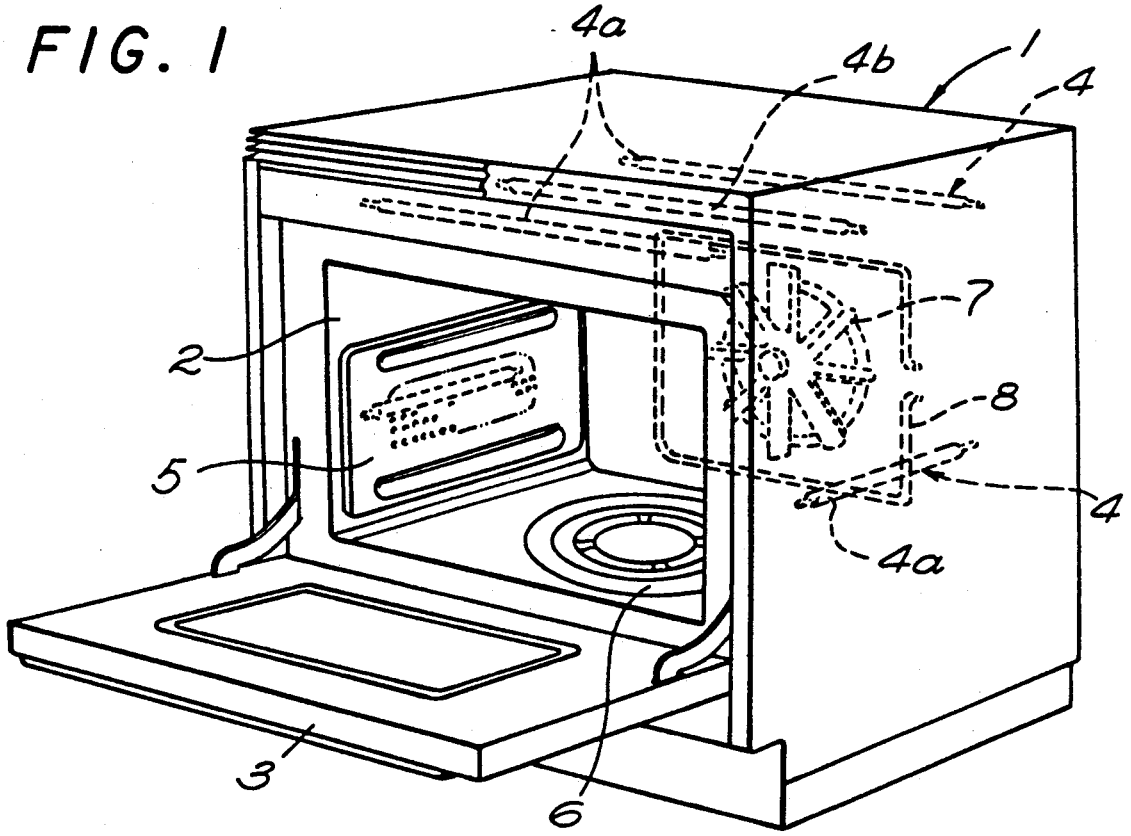
FIG. 1 is a perspective view of one example of an oven of this invention.
Figure 2:
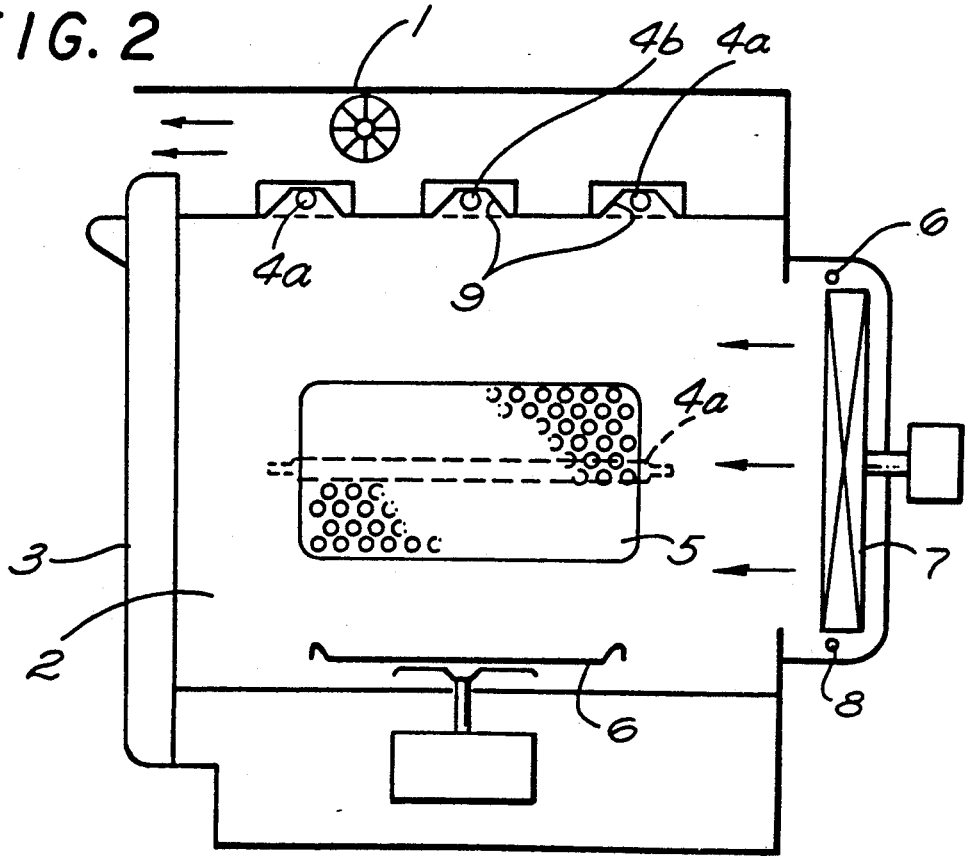
FIG. 2 is a sectional side view thereof.

Referring to the drawings, there are shown an oven main body 1, an oven chamber 2 provided in the oven main body 1, a door 3 which is provided on the front thereof and which can be opened and closed, and halogen lamps 4 provided in the oven chamber 2. The halogen lamps consist of halogen lamps **4*a* provided with a far infrared coating and a halogen lamp 4*b* without a far infrared coating. They will be described in more detail. The halogen lamps 4*a* provided with the far infrared coating are disposed in one piece each on both sides of the oven chamber 2 and further in two pieces in the front and the rear sides on the ceiling. The halogen map 4*b* without the far infrared coating is disposed in one piece on the ceiling between the lamps 4*a*, 4*a* disposed on the ceiling. In the illustrated embodiment, punched plates 5 are provided in front of the lamps 4 to protect them from mechanical shocks. A turntable 6 is disposed on the bottom of the oven chamber 2, a fan 7 is disposed in the rear of the oven chamber 2, and a sheath heater 8 is disposed such that it encloses the fan 7. Reflection plates 9 are provided at the back of each halogen lamp 4. Although not illustrated, reflection plates 9 are also provided at the back of halogen lamps 4*a***, on both sides.

Figure 3:
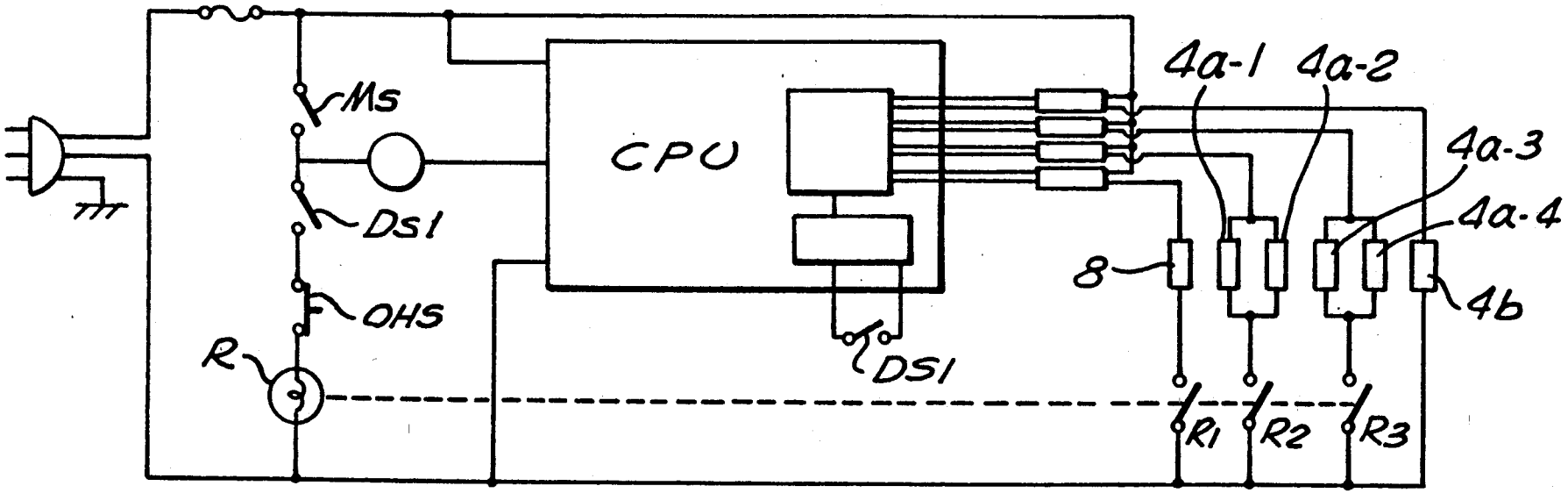
FIG. 3 is a control circuit diagram.

FIG. 3 shows the control circuit. Among the halogen lamps 4 interposed in the control circuit, the halogen lamp **4*b* without the far infrared coating is controlled by a CPU which is connected to a power source via a main switch Ms. The halogen lamps 4*a* with the far infrared coating and the sheath heater 8 are controlled by the CPU which is connected to the power source via the main switch Ms as well as by relay contacts r1, r2 and r3 of a relay R which is connected to the power source via the main switch Ms, a door switch Ds, and a normally closed switch Ohs which is opened by being interlocked with an overheating prevention device. In FIG. 3 reference numerals 4*a*-1 and 4*a*-2 denote halogen lamps disposed on the sides, and 4*a*-3 and 4*a*-4 denote halogen lamps disposed on the ceiling. The lamps on the sides and those on the ceiling are respectively controlled in the same manner. The halogen lamps 4*a*, 4*b* disposed on the ceiling are, for example, 700 W and each of those on the sides is 500 W, and the sheath heater 8** is 1.2 kW.

Next, cooking in the oven is explained. When yeast fermentation (baking) is performed, the output of each of the lamps **4*a* which are provided with the far infrared coating and which are disposed on the sides and on the ceiling is ¼ of the total output and, at the same time, the output of the lamp 4*b* without the far infrared coating is 50 W, which corresponds to 1/14 of the total output. Further, the temperature of the oven chamber is controlled to 35° C: by operating the temperature control function only to the lamps 4*a* for performing cooking. Next, when oven cooking is performed, the output of the lamps 4*a* disposed on the ceiling is ½ of the total output and, at the same time, the output of the lamp 4*b* without the far infrared coating is 50 W. Further, the remaining lamps 4*a* and the heater 8 are operated at their full outputs and, by giving the temperature control function to the lamps 4*a* and the heater 8, the temperature inside the oven chamber is kept at 160° to 250° C. When grill cooking is performed, all of the lamps 4*a* and 4*b* are operated at their full outputs and, at the same time, the sheath heater 8 is non-operating. By giving the temperature control function to the lamps 4*a* and 4*b*, the temperature inside the grill chamber is kept at 300° C. for performing cooking. Further, when heating foodstuffs, the output of the lamps 4*a* with the far infrared coating is ½ of the total output and, at the same time, the output of the lamp 4*b* without the far infrared coating is 50 W, which corresponds to 1/14 of the total output, for performing cooking. In other words, the sheath heater 8 is non-operative and the temperature control function is given only to the lamps 4*a* to keep the temperature inside the oven chamber at 80° C. When defrosting foodstuffs, the output of the lamps 4*a* with the far infrared coating is ¼ of the total output and, at the same time, the output of the lamp 4*b* without the coating is 50 W, which corresponds to 1/14 of the total output. In other words, the sheath heater 8 is non-operative and the temperature control function is given only to the lamps 4*a* to keep the temperature inside the grill chamber at 40° C. Further, for dry purposes, the output of the lamps 4*a* with the far infrared coating disposed on the ceiling is ½ of the total output and, at the same time, the output of the lamp 4*b* without the coating is 50 W, which corresponds to 1/14 of the total output, and the temperature control function is given to only the lamps 4*a*** to keep the temperature inside the oven chamber at 60° C. The fan 7 inside the oven chamber is operated in all cases except in the case of grill cooking. When the lamp 4*b* without the far infrared coating is operated at 50 W as described above, it functions only for lighting purpose.

Since the oven of this invention has the above-mentioned construction, it has the following effects.

The oven is provided inside the oven chamber thereof with at least one halogen lamp provided with a far infrared coating and at least one halogen lamp without the coating and, therefore, by combining them it is possible to perform heating cooking and cooking with scorching. Further, since the lamp without the coating can function as a lamp for lighting, it is needless to separately provide a lamp for lighting purpose.

The preferred oven is so constructed that the lamps can be independently controlled and, therefore, the combination thereof makes it possible to perform various kinds of cooking.

We claim:

1. An oven comprising at least one halogen lamp provided with a far infrared radiation coating and at least one halogen lamp without a far infrared radiation coating being disposed in a grill chamber having on the front side thereof, a door that is freely capable of opening and closing, and means for independently controlling said halogen lamps whereby to permit operation of each lamp at a different amount of output.

2. An oven as described in claim 1 including a sheath heater and an oven fan, and means for separately programming:

(a) the amount of output of said lamp without a far infrared radiation coating and the amount of output of said lamp with a far infrared + radiation coating, and (b) said oven fan and said sheath heater, in each cooking function; and temperature control means for controlling each cooking function.

3. An oven as described in claim 1, including an oven fan, and means for controlling the temperature and separately programming the functions of yeast fermentation, oven cooking, temperature keeping, thawing and drying, the amount of output of said lamp with a far infrared radiation coating and the oven fan whereby the lamp without a far infrared radiation coating is programmable in a lower output and the control thereof can be arbitrarily adjusted on or off.

4. An oven as described in claim 1 wherein the lamp without a far infrared coating constitutes the sole means for lighting said oven.

* * * * *

UNITED STATES PATENT AND TRADEMARK OFFICE

CERTIFICATE OF CORRECTION

PATENT NO. : 5,157,239
DATED : October 20, 1992
INVENTOR(S) : Kanaya, et. al.

It is certified that error appears in the above-indentified patent and that said Letters Patent is hereby corrected as shown below:

Abstract:

On the Title page, item [57] Line 1, delete "There is disclosed" and insert therefor --In--.

Line 1, delete "comprising" and insert therefor--having--.

Line 6, before the period, add --the output level of the lamps being controllable --.

Column 1, between lines 1 and 2, add, as two separate lines, --DESCRIPTION OF THE INVENTION -- and --1. FIELD OF THE INVENTION--.

Column 1, between lines 5 and 6, add-- 2. DESCRIPTION OF RELATED ART--.
Column 1, between lines 13 and 14, add --SUMMARY OF THE INVENTION --
Column 1, line 11, delete "extend" and insert therfor --extent--.
Column 1, line 9, delete "a".
Column 1, between lines 42 and 43, add--BRIEF DESCRIPTION OF THE DRAWINGS--
Column 1, between lines 48 and 49, add --DESCRIPTION OF THE PREFERRED EMBODIMENT--

Signed and Sealed this

Nineteenth Day of October, 1993

*Attest:*

Bruce Lehman

BRUCE LEHMAN

*Attesting Officer*

*Commissioner of Patents and Trademarks*